United States Patent [19]

Wheldon et al.

[11] 4,180,756

[45] Dec. 25, 1979

[54] THYRATRONS

[75] Inventors: Robert J. Wheldon, Chelmsford; Christopher V. Neale, Hatfield Peverel, both of England

[73] Assignee: English Electric Valve Company Limited, Chelmsford, England

[21] Appl. No.: 923,349

[22] Filed: Jul. 10, 1978

[51] Int. Cl.[2] ..... H01J 61/00

[52] U.S. Cl. ..... 313/193; 313/196; 313/189

[58] Field of Search ..... 313/193, 195, 196, 189

[56] References Cited

U.S. PATENT DOCUMENTS 3,165,660 1/1965 Menown ..... 313/196 X

*Primary Examiner*—Rudolph V. Rolinec

*Assistant Examiner*—Darwin R. Hostetter

*Attorney, Agent, or Firm*—Diller, Ramik & Wight

[57] ABSTRACT

This invention concerns gas filled thyratrons and is concerned with preventing the formation of arc spots on the grid when the thyratron is operated in a grounded grid mode. The thyratron provided has a grid consisting of three apertured baffle electrodes which are electrically united and occur in sequence in the cathode to anode path of the thyratron. The baffle electrodes on the cathode side of the final baffle electrode forms at least one re-entrant hollow cathode and conductive gauze covered apertures in the baffle electrodes on the cathode side of the final baffle electrode are staggered relative to apertures in the final baffle electrode.

8 Claims, 1 Drawing Figure

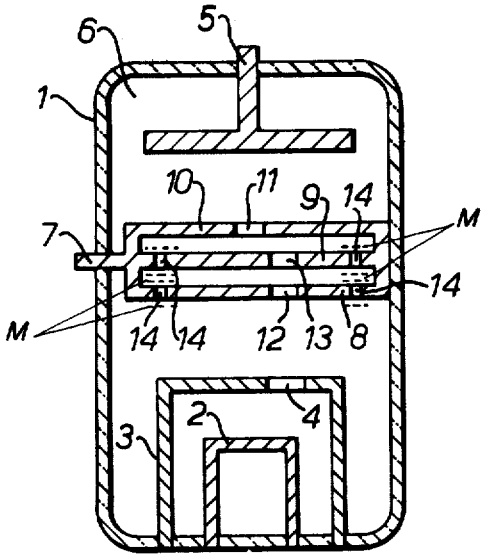
6
5
1
10
11
9
14
M
7
14
M
14
14
12
13
8
2
4
3

THYRATRONS

This invention relates to thyratrons and in particular to thyratrons having a gas filling of hydrogen or deuterium.

Conventionally a gas filled thyratron operates with its cathode connected to the negative terminal of a capacitive discharge circuit and its anode connected to the positive terminal of the discharge circuit. Between the cathode and anode of the thyratron are one or more grids, which control the penetration of the anode field to the cathode. In order to initiate the discharge of the thyratron a positive going trigger pulse is applied to the or one of the grids.

An alternative mode of operation involves the grid of the thyratron nearest to its anode being grounded, i.e. connected to the negative terminal of a discharge circuit. In this case initiation of discharge may be achieved by applying a negative trigger pulse to the cathode (which is not grounded) or a positive going pulse to a second grid located between the first, grounded, grid and the cathode. The advantage of this mode of operation is that relatively high rates of rise of current can be achieved due to the short low inductance discharge path within the tube. Furthermore, the grounded grid provides electro-static screening of the triggered electrode, in this case the cathode or further grid.

However, if a conventional thyratron is operated in a grounded grid mode, the fact that current is drawn from a normally non-emitting grid can result in the formation of an arc spot on the grid. Material which is sputtered from any such arc spot will cause degradation of the voltage hold-off capability of the tube.

The present invention seeks to provide an improved gas filled thyratron in which the above difficulty associated with grounded grid mode of operation is reduced.

According to this invention, a gas filled thyratron is provided having a cathode and an anode and, there between, at least one grid which in operation may be grounded, said grid comprising at least three apertured baffle electrodes electrically united and occurring in sequence in the cathode-to-anode path of the thyratron, the baffle electrodes on the cathode side of the final baffle electrode forming at least one re-entrant hollow cathode.

Each baffle electrode may include one or more apertures.

Preferably the apertures in the baffle electrodes on the cathode side of the final baffle electrode are staggered relative to the aperture or apertures in said final baffle electrode.

Preferably the baffle electrodes on the cathode side of the final baffle electrode are provided with apertures around their peripheries.

Preferably said last mentioned apertures are covered on both sides by conductive gauze.

The apertures in any of said baffle electrodes may take any cross sectional shape, e.g. rectangular, circular or annular.

Said baffle members are preferably formed of one of the materials tungsten, molybdenum, copper or nickel.

In one example of thyratron in accordance with the present invention in which each of the baffle electrodes on the cathode side of the final baffle electrode has one aperture, preferably said last mentioned aperture is from four to ten millimeters in width.

Preferably again each of the baffle electrodes on the cathode side of the final baffle electrode are spaced one from another by from one to ten millimeters.

The invention is illustrated in and further described with reference to the accompanying drawing which is a schematic cross section of one hydrogen thyratron in accordance with the present invention.

Referring to the drawing, the thyratron has a glass envelope 1 having at one end a cathode 2, which cathode is surrounded by a cathode shield 3 having an exit aperture 4. At the other end of the thyratron is an anode 5.

The thyratron has a gas filling 6 of hydrogen.

Between the cathode 2 and the anode 5 is a grid 7, which in operation may be grounded if the thyratron is to be operated in grounded grid mode.

The grid 7 consists of three apertured baffle electrodes 8, 9 and 10 occuring in sequence in the cathode-to-anode path. The final baffle electrode 10 has a central aperture 11. The baffle electrodes 8 and 9 on the cathode side of final baffle electrode 10, each has a single aperture 12 or 13, which, whilst aligned with each other, are diplaced to one side of the central position, so that aperture 11 is staggered with respect to apertures 12 and 13.

Around the peripheries of baffle electrodes 8 and 9 are series of apertures 14, which are covered on both sides by conductive metal mesh M. The purpose of providing the peripheral apertures 14 is to provide gas return paths which may assist conductivity.

The whole of grid 7 in this example is made of tungsten. In this example also the spacing between baffle electrodes 8 and 9 is five millimeters, whilst the width of each aperture 12 and 13 is seven millimeters. In this present example, the apertures 11, 12 and 13 are circular in cross section.

With a thyratron as described above arranged for operation in grounded grid mode, with grid electrode 7 grounded, in the non-pulsing condition the baffle electrode 10, partly aided by baffle electrode 9, controls the anode field penetration through the grid structure. Baffle electrodes 8 and 9 constitute between them a re-entrant hollow cathode structure.

If a negative going trigger pulse is applied to the cathode 2 and the heat shield 3, a triggering plasma is formed in the region of the apertures 11, 12 and 13 within the structure of grid 7. This causes ionisation of the gaseous filling between the grid 7 and the anode 5. A relatively rapid buildup of ion oscillations occurs in the cavity between baffle electrodes 8 and 9 and this provides a source of electrons for the main discharge pulse. Because this is independent of the cathode 2 the risk of arc formation is considerably reduced.

It will be appreciated that the thyratron illustrated in the accompanying drawing and described above is of a very simple nature for ease of illustration. However, in thyratrons in accordance with the present invention, further grids may be provided, particularly between grid 7 and anode 5, and additonal baffle electrodes, like baffle electrodes 8 and 9, may be provided on the cathode side of the grid 7.

We claim:

1. A gas filled thyratron for switching the current in a discharge circuit, said thyratron having a thermionic cathode and an anode and, therebetween, at least one grid which in operation may be grounded, said grid comprising at least three electrically and mechanically united apertured baffle electrodes occurring in sequence in the thermionic cathode-to-anode path of the thyratron, the baffle electrodes on the cathode side of the final baffle electrode forming at least one re-entrant hollow non-thermionic cathode which is capable of conducting the full discharge current without degradation, the discharge current path being short and of low impedance.

2. A thyratron as claimed in claim 1 and wherein the apertures in the baffle electrodes on the cathode side of the final baffle electrode are staggered relative to the aperture or apertures in said final baffle electrode.

3. A thyratron as claimed in claim 1 or 2 and wherein the baffle electrodes on the cathode side of the final baffle electrode are provided with apertures around their peripheries.

4. A thyratron as claimed in claim 3 and wherein said last mentioned apertures are covered on both sides by conductive gauze.

5. A thyratron as claimed in claim 1 or 2 and wherein said baffle members are formed of one of the materials tungsten, molybdenum, copper or nickel.

6. A thyratron as claimed in claim 1 or 2 and in which each of the baffle electrodes on the cathode side of the final baffle electrode has one aperture and wherein said last mentioned aperture is from four to ten millimeters in width.

7. A thyratron as claimed in claim 1 or 2 and wherein each of the baffle electrodes on the cathode side of the final baffle electrode are spaced one from another by from one to ten millimeters.

8. A thyratron for switching the current in a discharge circuit, comprising in combination:

a gas-filled envelope having an anode and a thermionic cathode disposed in spaced apart relation therein; and baffle electrode means disposed between said anode and said thermionic cathode for effecting operation of said thyratron in grounded grid mode, said baffle electrode means comprising a pair of electrically and mechanically united apertured baffle electrodes defining a cavity therebetween and constituting between them a re-entrant hollow non-thermionic cathode structure, and at least one further apertured baffle electrode electrically and mechanically united with said pair, said further baffle electrode being spaced from said pair on the anode side thereof whereby, when the tube is triggered, a rapid build-up of ion oscillations occurs in said cavity to provide a source of electrons for the discharge current which is independent of said thermionic cathode, said baffle electrode means having a terminal connection portion projecting outwardly directly through said envelope for connecting the discharge circuit thereto.

* * * * *